US009234652B2

(12) United States Patent
Wu

(10) Patent No.: US 9,234,652 B2
(45) Date of Patent: Jan. 12, 2016

(54) LED DISPLAY MODULE WITH QUICK MOUNTING-DISMOUNTING STRUCTURE

(75) Inventor: Xiaogang Wu, Shenzhen (CN)

(73) Assignee: Shenzhen Chip Optech Co. Ltd., Shenzhen, Guangdong Province (CN)

( * ) Notice: Subject to any disclaimer, the term of this patent is extended or adjusted under 35 U.S.C. 154(b) by 248 days.

(21) Appl. No.: 13/989,773

(22) PCT Filed: May 14, 2012

(86) PCT No.: PCT/CN2012/000651

§ 371 (c)(1), (2), (4) Date: May 24, 2013

(87) PCT Pub. No.: WO2013/159252

PCT Pub. Date: Oct. 31, 2013

(65) Prior Publication Data

US 2014/0085864 A1 Mar. 27, 2014

(30) Foreign Application Priority Data

Apr. 23, 2012 (CN) ..... 2012 1 0119394

(51) Int. Cl.

*F21V 11/00* (2015.01)
*F21V 19/00* (2006.01)
*G09F 9/33* (2006.01)
*F21V 7/00* (2006.01)

(52) U.S. Cl.

CPC ..... *F21V 19/001* (2013.01); *G09F 9/33* (2013.01); *F21V 7/00* (2013.01)

(58) Field of Classification Search

CPC ..... F21V 19/001; F21V 7/00; G09F 9/33
USPC ..... 362/217.12, 217.15, 217.16, 225, 613, 362/97.3, 634
See application file for complete search history.

(56) References Cited

U.S. PATENT DOCUMENTS 8,025,422 B1 * 9/2011 Huang et al. ..... 362/241
8,292,448 B2 * 10/2012 Kim et al. ..... 362/97.3
8,646,933 B2 * 2/2014 Kim et al. ..... 362/97.3

* cited by examiner

*Primary Examiner* — Anabel Ton
(74) *Attorney, Agent, or Firm* — Novoclaims Patent Services LLC; Mei Lin Wong

(57) ABSTRACT

A LED display module with a quick mounting-Dismounting structure comprising: a mask; a bottom shell; and an LED lamp board; the LED display module further comprises a quick mounting-dismounting unit, wherein the quick mounting-dismounting unit is adapted to be provided the LED display module to fixed to the frame of display screen or removed from the frame of display screen quickly.

9 Claims, 6 Drawing Sheets

LED DISPLAY MODULE WITH QUICK MOUNTING-DISMOUNTING STRUCTURE

BACKGROUND OF THE PRESENT INVENTION

1. Field of Invention

The present invention relates to a LED display module, in particular a LED display module which having a quick mounting-Dismounting unit. The LED display module can be fixed on the frame of display screen or removed from the frame quickly by the quick mounting-Dismounting unit.

2. Description of Related Arts

It is well known that with the development of LED technology the LED display module which uses LED as the light source has been widely used. It realizes display by controlling semiconductor light-emitting diode and it is generally composed of plenty of light-emitting diodes and it displays characters by the turning on or off of the LED light.

In the specific implementation, the LED display module can be used to display text, graphics, images, animation, quotes, video, video signals and other information. LED display module can be used indoor and outdoor, it has incomparable advantages compared with the projector, TV wall and LCD display screen. The wide attention and rapid development of LED display module due to its advantages such as high brightness, low work voltage, low consumption, miniaturization, long life and so on.

In specific implementation for a particular location, a large LED display screen is usually required. In this case, large LED display screens are all assembled by several LED display modules, and when it is implemented, a number of LED display modules are made to work together by auxiliary hardware equipment and software to achieve the purpose of displaying large graphic information.

In fact, several LED display modules are fixed respectively to the overall framework of the LED display screen to form a large LED display screen. However, LED display modules are fixed to the framework by screws or other simple connecting elements in prior art and such connection results in the inconvenient maintenance in late, for example, when some LED display modules damaged need to be removed or repaired, maintenance personnel need to sequentially remove all screws fixing the LED display to remove the module overall and maintain it. Removing the LED display module in this manner is very inconvenient for the specific implementation, and this is the major disadvantage of the conventional technique.

SUMMARY OF THE PRESENT INVENTION

The present invention provides an LED display module with a rapid mounting-Dismounting structure, wherein the module having a quick mounting-Dismounting unit by which the LED display module can be fixed to the frame of display screen or removed from the frame quickly and this is convenient for assembling, removing or maintaining, and this is the main object of the present invention.

The present invention has such advantageous, firstly, it having a quick mounting-dismounting unit by which the LED display module can be fixed to the frame of display screen or removed from the frame quickly and this is convenient for assembling, removing or maintaining; secondly, an external force transmission part penetrates the LED display module with one end being exposed out from a mask and the other end being exposed on a bottom shell, and then the assembling and removing force applied by the operator on the quick mounting-dismounting unit can respectively act on the external force transmission part in the direction of front and back and this is convenient for the operation; again, the movement locking part of the present invention is slideably attached on the surface of the bottom shell, so the movement locking part can transform between locking state and unlocking state by the sliding of the locking part on the surface of the bottom shell. The quick mounting-dismounting unit can be complemented by the sliding of the movement locking part without increasing the thickness of the LED display module.

According to the present invention, the foregoing and other objects and advantages are attained by a led display module with a quick mounting-Dismounting structure comprising:

a mask (100);

a bottom shell (200); and an LED lamp board;

wherein the mask (100) is fixed on the bottom shell (200), the LED lamp board is fixed between the mask (100) and the bottom shell (200), At least one of LED lamps on the LED lamp board penetrates out from lamp hole (300) of the mask (100) and exposes to the outside of the LED display module, At least one of the LED display modules are installed on a frame of display screen in turn, such that the LED display modules can be assembled together and form an overall LED display screen, The LED display module further comprises a quick mounting-Dismounting unit (400), wherein the quick mounting-Dismounting unit (400) is adapted to be provided the LED display module to fixed to the frame of display screen or removed from the frame of display screen quickly, the quick mounting-Dismounting unit (400) is positioned on the bottom shell (200), wherein The quick mounting-Dismounting unit (400) comprises an external force transmission part (10) and a movement locking part (20), the external force transmission part (10) is connected with the movement locking part (20), the external force transmission part (10) transfer a force applied to the movement locking part (20) such that the movement locking part (20) can transform between a locking state and an unlocking state, in the locking state, the LED display module is fixed to the frame of display screen, and in the unlocking state, the LED display module is removed from the frame of display screen, the external force transmission part (10) penetrates the LED display module with one end being exposed from the mask (100) and the other end being exposed from the bottom shell (200), the fixing force and the removing force applied by the operator on the quick mounting-Dismounting unit (400) can respectively act on the external force transmission part (10) in the direction of front and back, the movement locking part (20) is attached on the surface of the bottom shell (200) slideably, such that the movement locking part (20) can transform between the locking state and the unlocking state by sliding on the surface of the bottom shell (200).

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

As shown in FIGS. 1-10, a LED display module 1 with a quick mounting-Dismounting structure comprises a mask 100, a bottom shell 200 and a LED lamp board 500.

Figure 1:
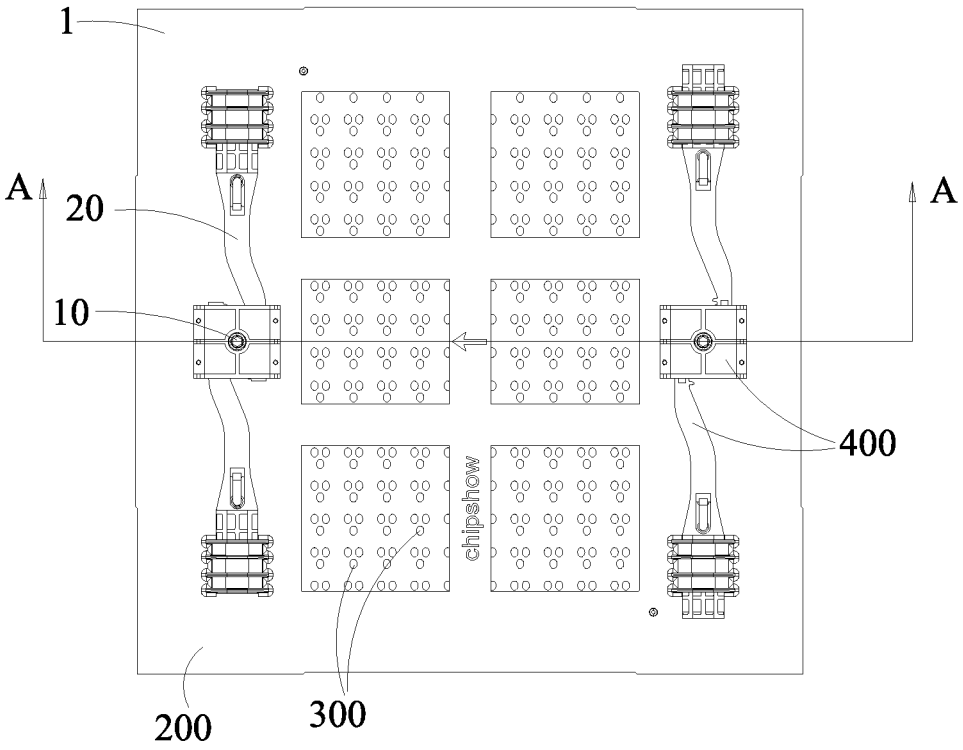
FIG. 1 shows a rear view of the present invention.
Figure 2:
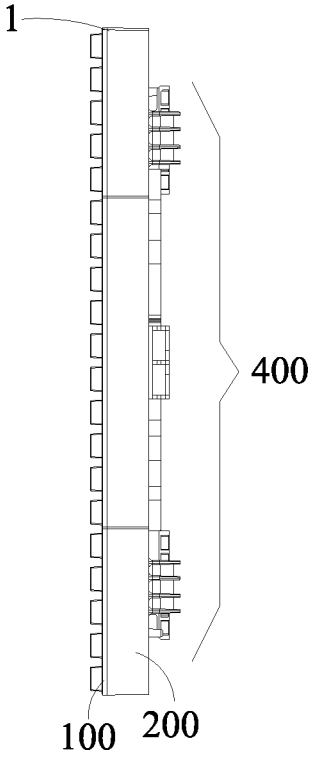
FIG. 2 shows a side view of the present invention.
Figure 3:
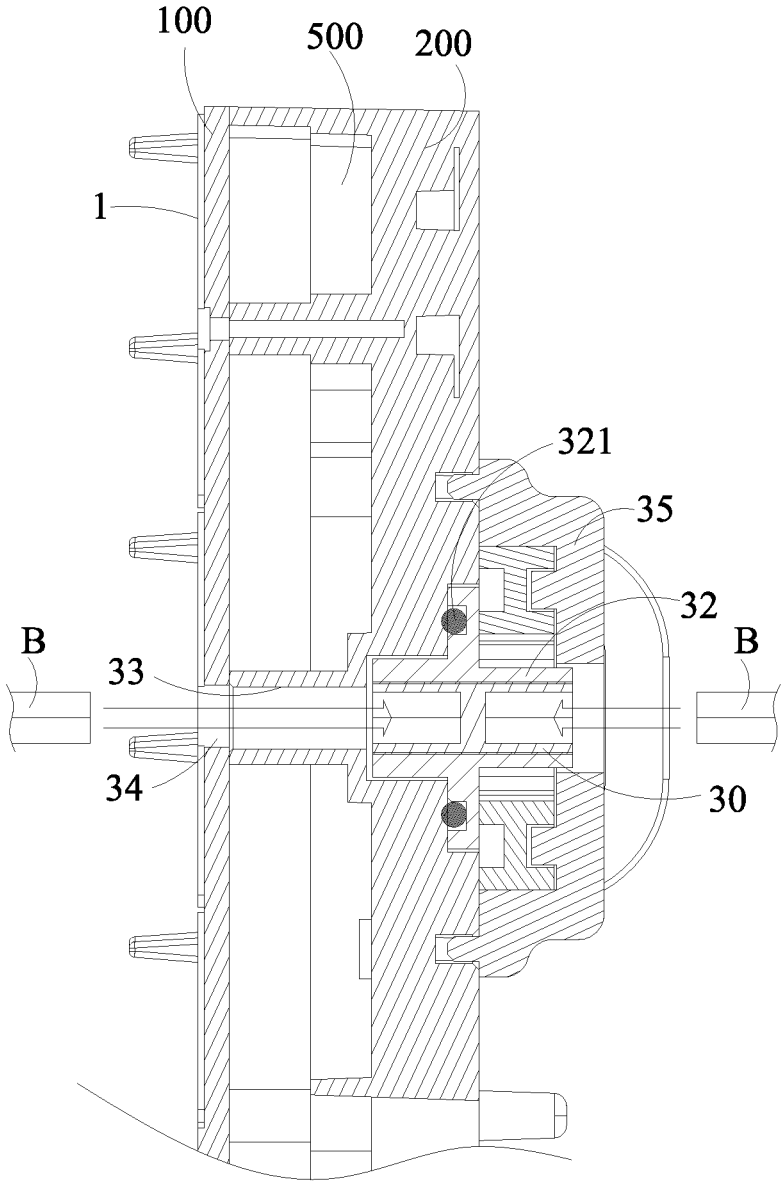
FIG. 3 is a partial schematic diagram corresponding to section lines A-A in FIG. 1.
Figure 4:
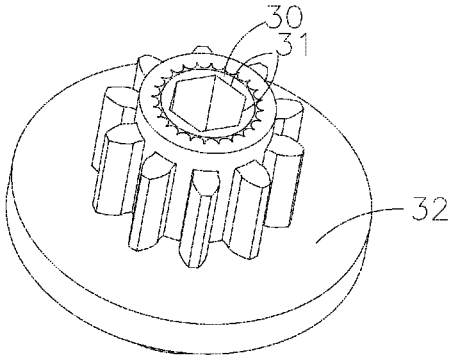
FIG. 4 is a perspective schematic diagram of the external force transmission part according to the present invention.
Figure 5:
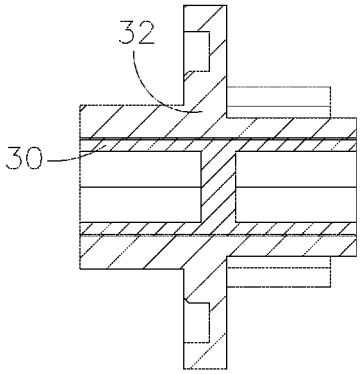
FIG. 5 is a section schematic diagram of the external force transmission part according to the present invention.
Figure 6:
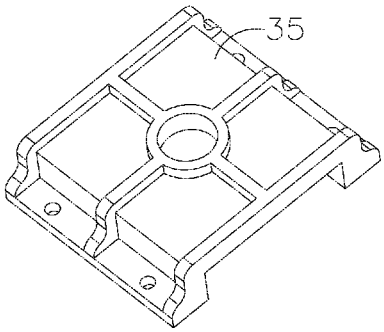
FIGS. 6 and 7 are perspective schematic diagrams of the external fixed housing according to the present invention.
Figure 7:
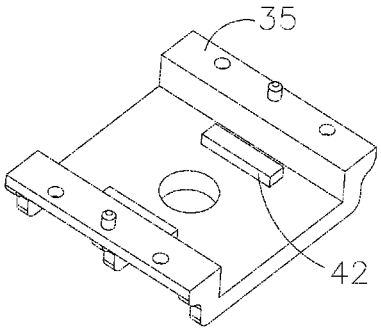
Figure 8:
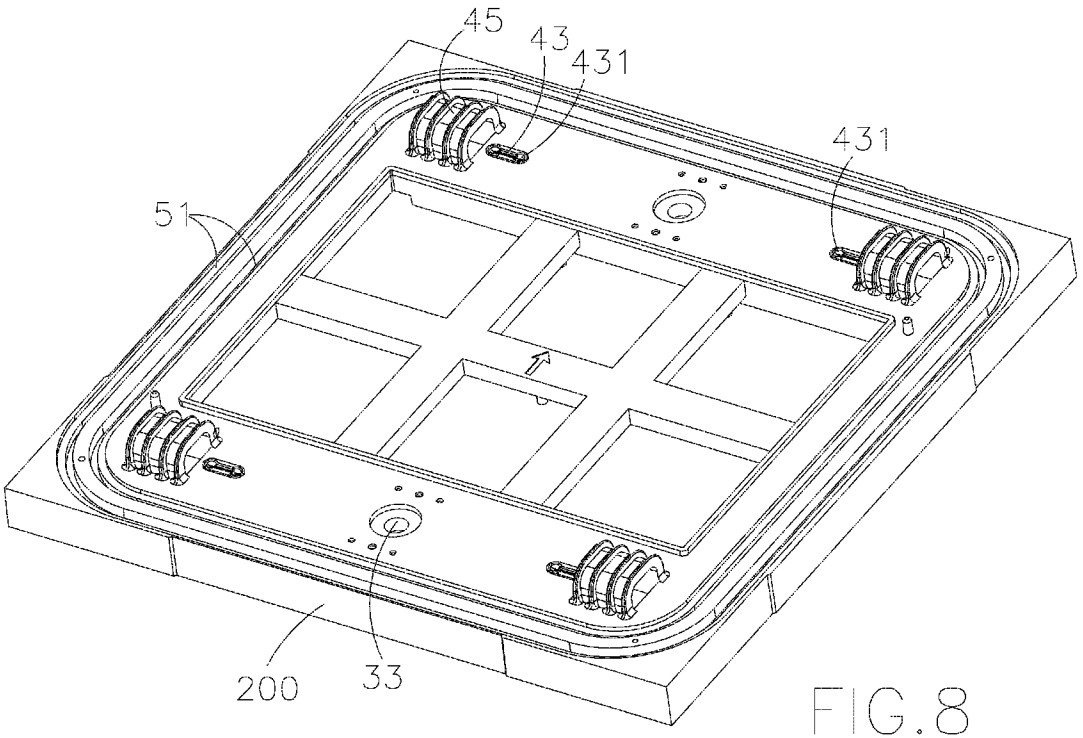
FIG. 8 is a perspective schematic diagram of the bottom shell according to the present invention.
Figure 9:
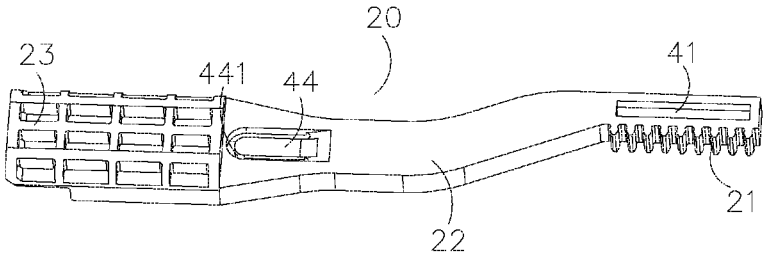
FIG. 9 is a perspective schematic diagram of the movement locking part according to the present invention.
Figure 10:
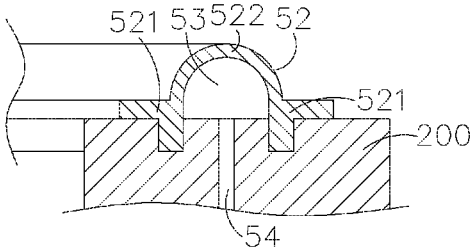
FIG. 10 is a section schematic diagram of the sealed waterproof part according to the present invention.

As shown in FIGS. 1-3, the mask 100 is fixed on the bottom shell 200, and the LED lamp board is fixed between the mask 100 and bottom shell 200.

LED lamp on the lamp board 500 penetrates out from the lamp hole 300 of the mask 100 and exposes to the outside of the LED display module 1.

When the LED display module is electrified to work, LED lamps emit light and display graphics and animation.

In the specific implementation, a number of the LED display modules 1 are sequentially installed on the frame of display screen, so that the LED display modules 1 can be assembled together and form an overall LED display screen.

The LED display module also comprises a quick mounting-Dismounting unit 400 by which the LED display module can be fixed to the frame of display screen or removed from the frame quickly.

The quick mounting-Dismounting unit 400 which comprises an external force transmission part 10 and a movement locking part 20 is positioned on the bottom shell 200.

The external force transmission part 10 is connected with the movement locking part 20.

The external force transmission part 10 transfer the force applied on the quick mounting-Dismounting unit 400 by the operator to the movement locking part 20 so that the locking part 20 can transform between locking state and unlocking state.

Refers to the right part of FIG. 1, when the movement locking part 20 is in locking state, the LED display module is fixed to the frame of display screen. Refers to the left part of FIG. 1, when the movement locking part 20 is in unlocking state, the LED display module is removed from the frame of display screen.

The external force transmission part 10 penetrates the LED display module with one end being exposed from the mask 100 and the other end being exposed on the bottom shell 200.

That means the assembling force and removing force applied by the operator on the quick mounting-Dismounting unit 400 can respectively act on the external force transmission part 10 in the direction of front and back.

The movement locking part 20 can be slideably attached on the surface of the bottom shell 200, so the movement locking part 20 can transform between locking state and unlocking state by the sliding of the locking part 20 on the surface of the bottom shell 200.

In implementation, because the general LED display module is in plate shape, the thickness of the LED display screen formed by the assembling of LED display modules is not too large so that it can be hang on the surface of wall and floor. The quick mounting-Dismounting unit 400 can be complemented by the sliding of the movement locking part 20 without increasing the overall thickness of the LED display module.

As shown in FIGS. 1-5, the external force transmission part 10 is a rotating column 30.

The rotating column 30 has an internal cavity and two ports which are positioned respectively at the two ends of the internal cavity. Plenty of clamp platforms 31 are provided in the inside cavity.

When it is implemented, clamp platform 31 can be connected together and form a hex bolt structure, that means operator can rotate the rotating column 30 just by the tools B like outer hexagonal screw.

A gear ring 32 is sheathed at the rotating column 30.

A seal ring 321 is embedded in the gear ring 32.

A step hole 33 is arranged concavely on the bottom of the bottom shell 200 towards the mask 100. The gear ring 32 is rotatablely arranged in the step hole 33.

The seal ring 321 is arranged between the step hole 33 and the gear ring 32.

One end of the step hole 33 is positioned on the bottom of the bottom shell 200, while the other end is communicated with the through hole 34 positioned on the mask 100.

When the gear ring 32 and rotating column 30 are arranged in the step hole, operator can rotate the rotating column 30 in the direction of mask 100 and bottom shell 200 by tools like hexagonal screw.

As shown in FIG. 1-7, fixed housing 35 is fixed to the bottom shell 200, and covers the gear ring 32 and rotating column 30 so that the gear ring 32 and rotating column 30 can be restricted in the step hole 33.

As shown in FIG. 1-9, the movement locking part 20 comprises a rack 21, a connecting rod 22 and a clamping head 23 which are integrally connected.

The rack 21 is engaged with the gear ring 32.

When the gear ring 32 is rotated, the rack 21 drives the connecting rod 22 and clamping head 23 to slide on the surface of the bottom shell 200 to realize the transformation between locking and unlocking of the movement locking part 20.

In specific implementation, movement locking parts 20 can be respectively arranged on the upper and lower side of the gear ring 32. When the gear ring 32 is rotated, movement locking parts 20 positioned on two sides slides in opposite direction; thereby the LED display module can be fixed to the frame of display screen at two sides.

The movement locking part 20 further comprises a stroke limiting part by which the sliding path of the locking part 20 can be limited. On the one hand, the rack 21 is ensured not drop from the gear ring 32, on the other hand, the movement locking part 20 can smoothly slide on the bottom shell 20 without shifting.

The stroke limiting part includes a slide groove 41 which is concavely arranged on the top of the rack 21 and a slide block 42 which is fixed on the inner top surface of the fixed housing 35. The slide block 42 is inserted into the slide groove 41.

When the gear ring 32 drives the rack 21 to move around, the movement of the rack 21 is restricted by the slide groove 41 and the slide block 42, so that the rack 21 of the movement locking part 20 can be ensured not drop from the gear ring 32.

The stroke limiting part 40 further comprises a slide groove 43 of the bottom shell and an elastic slide rod 44, the slide groove 43 of the bottom shell is concavely arranged on the bottom surface of the bottom shell 200, and the end of the slide groove 43 is provided with a pit 431.

The elastic slide rod 44 and the slide groove 43 of the bottom shell are correspondingly arranged on the connecting rod 22. The ends of the elastic slide rod 44 are provided with project blocks 441.

The project block 441 is slideably arranged in the slide groove 43 of the bottom shell. When the movement locking part 20 is in locking state, the project block 441 slides into the pit 431 to fix the position of the movement locking part 20.

The stroke limiting part 40 further comprises a clamping head limiting cover 45 fixed on the bottom shell 200. The clamping head 23 is arranged in the cover 45 so that the movement of the clamping head 23 in the direction of up, down, front and back can be limited by the clamping head limiting cover 45.

As shown in FIG. 1-10, the LED display module further comprises a seal waterproof part.

The seal waterproof part includes an annular groove 51 which is concavely arranged on the bottom shell 200 and a waterproof ring 52.

The waterproof 52 comprises an annular rib 521 and an annular arc top 522 is made of flexible material, wherein the annular rib 521 is connected to the two sides of the annular arc top 522.

The annular rib 521 is embedded in the annular groove 51.

The bottom shell 200 and the annular arc top 522 define an air cavity 53.

The bottom shell 200 and the annular arc top 522 define an air cavity 53.

Because the waterproof ring is made of flexible material and the air cavity 53 is existed, when LED display modules are installed on the frame of display screen in turn, the waterproof 52 is positioned between the two members and form a flexible connection.

The bottom shell 200 is provided with plenty of airholes 54 on the bottom, wherein the airholes 54 penetrate the bottom shell 200. The mask 100 is fixed to the bottom shell 200 and form an assembling cavity which the LED display lamp board is arranged in.

One end of the airhole 54 is connected with the air cavity 53, and the other end is connected with the assembling cavity.

When the LED display modules are installed on the frame of the display screen in turn, and the air cavity 53 contracts under the pressure, then the air in the air cavity 53 can be discharged into the assembling cavity through the air hole 54, thereby the total amount of air in the air cavity 53 can be adjusted reasonably to ensure the safe and reliable connection between the LED display module and the frame of the display screen.

Finally, it is worth noting that plenty of quick mounting-Dismounting units 400 can be arranged on the bottom shell 200 to enhance connecting strength and meet different special requirements.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A LED display module with a quick mounting-dismounting structure adapted for connecting onto a frame of display screen, comprising:

a mask (100);

a bottom shell (200);

a LED lamp board; and a quick mounting-dismounting unit (400);

wherein the mask (100) is fixed on the bottom shell (200), the LED lamp board is fixed between the mask (100) and the bottom shell (200), and at least one of LED lamps on the LED lamp board penetrates out from lamp hole (300) of the mask (100) and exposes to the outside of the LED display module, comprises a quick mounting-Dismounting unit (400), wherein the quick mounting-dismounting unit (400) is positioned on the bottom shell (200), and comprises an external force transmission part (10) and a movement locking part (20), the external force transmission part (10) is connected with the movement locking part (20), the external force transmission part (10) transfer a force applied to the movement locking part (20) such that the movement locking part (20) is capable of transforming between a locking state and an unlocking state, in the locking state, the LED display module is fixed to the frame of display screen, and in the unlocking state, the LED display module is removed from the frame of display screen, the external force transmission part (10) penetrates the LED display module with one end being exposed from the mask (100) and the other end being exposed from the bottom shell (200), the fixing force and the removing force applied by the operator on the quick mounting-Dismounting unit (400) can respectively act on the external force transmission part (10) in the direction of front and back, the movement locking part (20) is attached on the surface of the bottom shell (200) slideably, such that the movement locking part (20) can transform between the locking state and the unlocking state by sliding on the surface of the bottom shell (200), thereby the LED display module is capable of being fixed to the frame of the display screen or removed from the frame of the display screen quickly, and one or more of the LED display modules is capable of being installed on the frame of the display screen and assembled together to form an overall LED display screen.

2. The LED display module with a quick mounting-dismounting structure, as recited in claim 1, wherein the external force transmission part (10) is a rotating column (30), the rotating column (30) has an internal cavity and two ports, wherein the two ports are positioned respectively at the two ends of the internal cavity, a plurality of clamp platforms (31) are provided in the internal cavity, a gear ring (32) is sheathed at the rotating column (30), a step hole (33) is arranged concavely on the bottom of the bottom shell (200) towards the mask (100), the gear ring (32) is rotatablely arranged in the step hole (33), one end of the step hole (33) is positioned on the bottom of the bottom shell (200), the other end of the step hole 33 is communicated with a through hole (34), wherein the through hole (34) is positioned on the mask (100).

3. The LED display module with a quick mounting-dismounting structure, as recited in claim 2, wherein a seal ring (321) is embedded in the gear ring (32), the seal ring (321) is arranged between the step hole (33) and the gear ring (32).

4. The LED display module with a quick mounting-dismounting structure, as recited in claim 2, wherein a fixed housing (35) is fixed to the bottom shell (200), and the fixed housing (35) covers the gear ring (32) and the rotating column (30) such that the gear ring (32) and the rotating column (30) can be restricted in the step hole (33).

5. The LED display module with a quick mounting-dismounting structure, as recited in claim 2, wherein the movement locking part (20) comprises a rack (21), a connecting rod (22) and a clamping head (23), wherein the rack (21), the connecting rod (22) and the clamping head (23) are integrally connected, wherein the rack (21) is engaged with the gear ring (32), when the gear ring (32) is rotated, the rack (21) drives the connecting rod (22) and the clamping head (23) sliding on the bottom shell (200) to realize the transformation between the locking state and the unlocking state of the movement locking part (20).

6. The LED display module with a quick mounting-dismounting structure, as recited in claim 5, wherein the movement locking parts (20) are respectively arranged on the upper and lower side of the gear ring (32), when the gear ring (32) is rotated, the two movement locking parts (20) are positioned on two sides slides in opposite direction; such that the LED display module can be fixed to the frame of display screen at two sides.

7. The LED display module with a quick mounting-dismounting structure, as recited in claim 5, wherein the movement locking part (20) further comprises a stroke limiting part, wherein the stroke limiting part defining a sliding path of the movement locking part (20), the stroke limiting part comprises a slide groove (41), wherein the slide groove (41) is concavely arranged on the top of the rack (21), and a slide block 42, wherein the slide block (42) is fixed on the inner top surface of the fixed housing (35), the slide block (42) is inserted into the slide groove (41), the stroke limiting part further comprises a bottom shell slide groove 43 and an elastic slide rod (44), Wherein the bottom shell slide groove (43) is concavely arranged on the bottom surface of the bottom shell (200), and a pit (431) is provided on the end of the bottom shell slide groove (43), the elastic slide rod (44) and the bottom shell slide groove (43) are arranged on the connecting rod (22), a project blocks (441) is provided on the ends of the elastic slide rod (44), the project block (441) is slideably arranged in the bottom shell slide groove (43), the project block (441) slides into the pit (431) to fix the position of the movement locking part (20), when the movement locking part (20) is in the locking state, the stroke limiting part (40) further comprises a clamping head limiting cover (45), wherein the clamping head limiting cover (45) is fixed on the bottom shell (200), the clamping head (23) is arranged in the cover (45).

8. The LED display module with a quick mounting-dismounting structure, as recited in claim 5, wherein the LED display module further comprises a seal waterproof part, wherein the seal waterproof part comprises an annular groove (51), wherein the annular groove (51) is concavely arranged on the bottom shell (200); and a waterproof ring (52), wherein the waterproof (52) comprises an annular rib (521) and an annular arc top (522), wherein the waterproof (52) is made of flexible material, the annular rib (521) is connected to the two sides of the annular arc top (522), the annular rib (521) is embedded in the annular groove (51), the bottom shell (200) and the annular arc top (522) defining an air cavity (53).

9. The LED display module with a quick mounting-dismounting structure, as recited in claim 5, wherein the bottom shell (200) is provided with plenty of airholes (54) on the bottom, wherein the airholes (54) are penetrate the bottom shell (200), the mask (100) is fixed to the bottom shell (200) and form an assembling cavity which the LED display lamp board is arranged in, one end of the airhole (54) is connected with the air cavity (53), and the other end is connected with the assembling cavity.

* * * * *